US006053512A

United States Patent [19]

Chang

[11] Patent Number: 6,053,512

[45] Date of Patent: Apr. 25, 2000

[54] SUSPENSION SYSTEM FOR IN-LINE ROLLER SKATES

[76] Inventor: Chuck Chang, No. 153-8, Lane 319, Yiu Yuan South Road, Long Gin Hsiang, Taichung Hsien, Taiwan

[21] Appl. No.: 09/063,861

[22] Filed: Apr. 21, 1998

[51] Int. Cl.[7] ..... A63C 17/02

[52] U.S. Cl. ..... 280/11.22; 280/11.28

[58] Field of Search ..... 280/11.22, 11.23, 280/11.27, 11.28

[56] References Cited

U.S. PATENT DOCUMENTS

| | | | |
|---|---|---|---|
| 5,503,413 | 4/1996 | Belogour | 280/11.22 |
| 5,586,774 | 12/1996 | Dentale | 280/11.22 |
| 5,690,344 | 11/1997 | Chen | 280/11.22 X |
| 5,842,706 | 12/1998 | Chang | 280/11.22 X |
| 5,890,724 | 4/1999 | Gignoux et al. | 280/11.28 |

FOREIGN PATENT DOCUMENTS

| | | | |
|---|---|---|---|
| 2566672 | 1/1986 | France | 280/11.22 |

*Primary Examiner*—Michael Mar

[57] ABSTRACT

A roller skate includes a base for supporting wheels and a support for attaching to a boot. The base includes a hub and a pair of slots. The support includes a pair of extensions extended downward for slidably engaging with the side portions of the base and for guiding and limiting the support to move up and down relative to the base. A shaft is secured to the extensions and slidably engaged in the pair of slots for limiting the up and down movement of the support relative to the base. A spring is engaged between the base and the support for cushioning the support.

6 Claims, 5 Drawing Sheets

SUSPENSION SYSTEM FOR IN-LINE ROLLER SKATES

BACKGROUND OF THE INVENTION

1. Field of the Invention

The present invention relates to a suspension system, and more particularly to a suspension system for in-line roller skates.

2. Description of the Prior Art

A typical in-line roller skate with a suspension system is disclosed in U.S. Pat. No. 5,503,413 to Belogour and comprises a boot including a front portion pivotally coupled to a base. A spring is disposed between the rear portions of the boot and the base. However, no limiting or guiding devices are provided for guiding the boot to move relative to the base such that the rear portion of the boot may be easily moved laterally relative to the base and such that the roller skate may be easily damaged after use.

The present invention has arisen to mitigate and/or obviate the afore-described disadvantages of the conventional in-line roller skates.

SUMMARY OF THE INVENTION

The primary objective of the present invention is to provide a roller skate having a stable suspension system for stably guiding the boot to move upward and downward relative to the base and for preventing the roller skate from being easily damaged.

In accordance with one aspect of the invention, there is provided a roller skate comprising a base for supporting wheels and having a hub and a pair of slots, a support for attaching to a boot including a pair of extensions for slidably engaging with the side portions of the base and for limiting the support to move up and down relative to the base, a shaft secured to the extensions of the support and slidably engaged in the slot of the base for limiting an up and down movement of the support relative to the base, and a spring member engaged between the base and the support for biasing the support away from the base.

A resilient member is engaged in the pair of slots for engaging with the shaft and for cushioning the shaft.

The support includes a guide wall extended downward and slidably engaged on the hub for further guiding the support to move upward and downward relative to the base. A resilient ring is engaged around the hub for engaging with the guide wall of the support and for cushioning the support.

A bolt is slidably engaged in the hub of the base and adapted to be adjusted up and down relative to the hub, the spring member is engaged with the bolt for allowing the bolt to adjust the spring member. The bolt includes an engaging hole for allowing the bolt to be rotated relative to the hub. The support has a front portion pivotally coupled to the base at a pivot pin.

Further objectives and advantages of the present invent ion will become apparent from a careful reading of a detailed description provided hereinbelow, with appropriate reference to accompanying drawings.

DETAILED DESCRIPTION OF THE PREFERRED EMBODIMENT

Figure 1:
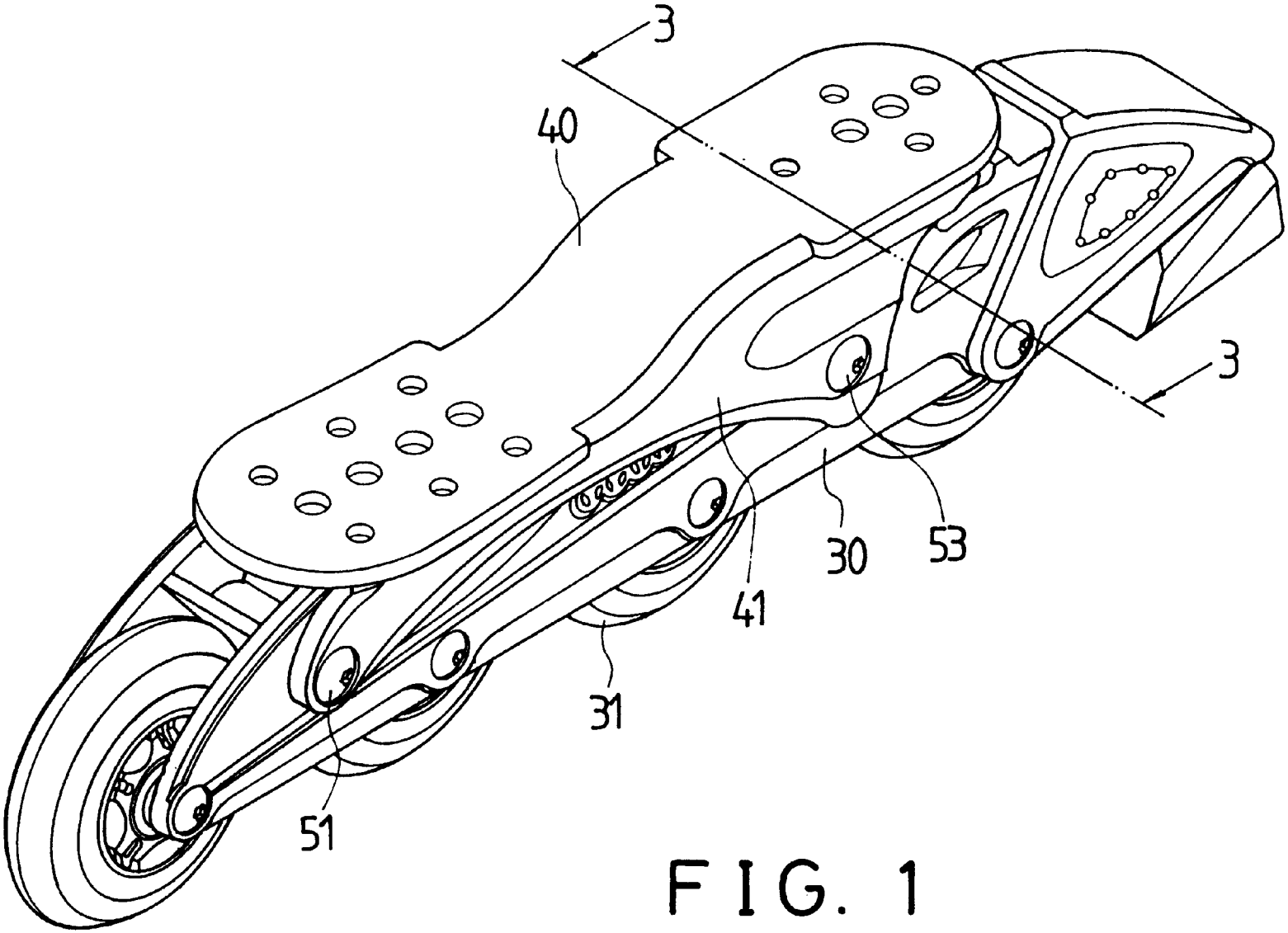
FIG. 1 is a perspective view of a roller skate in accordance with the present invention.
Figure 2:
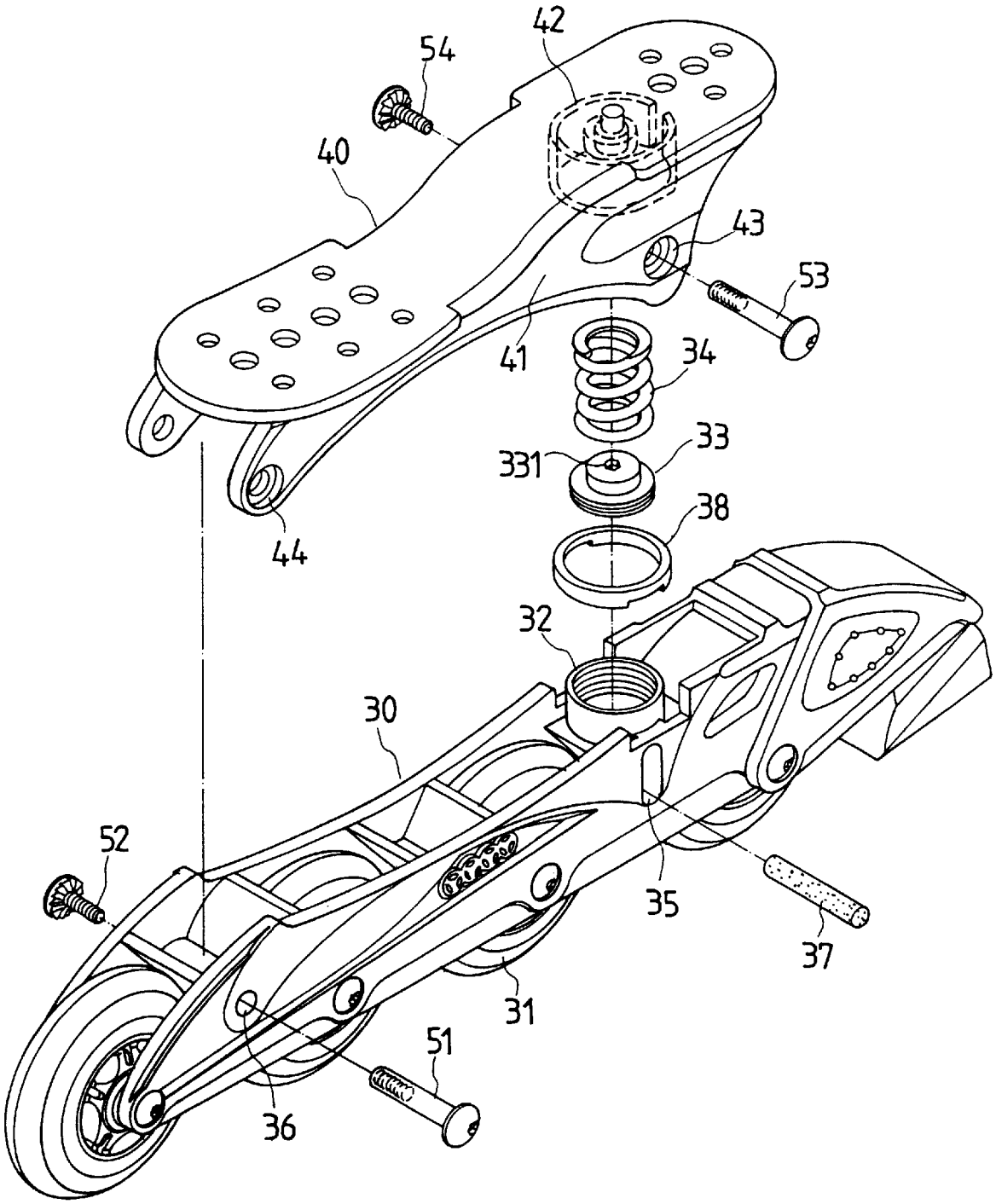
FIG. 2 is an exploded view of the roller skate.
Figure 3:
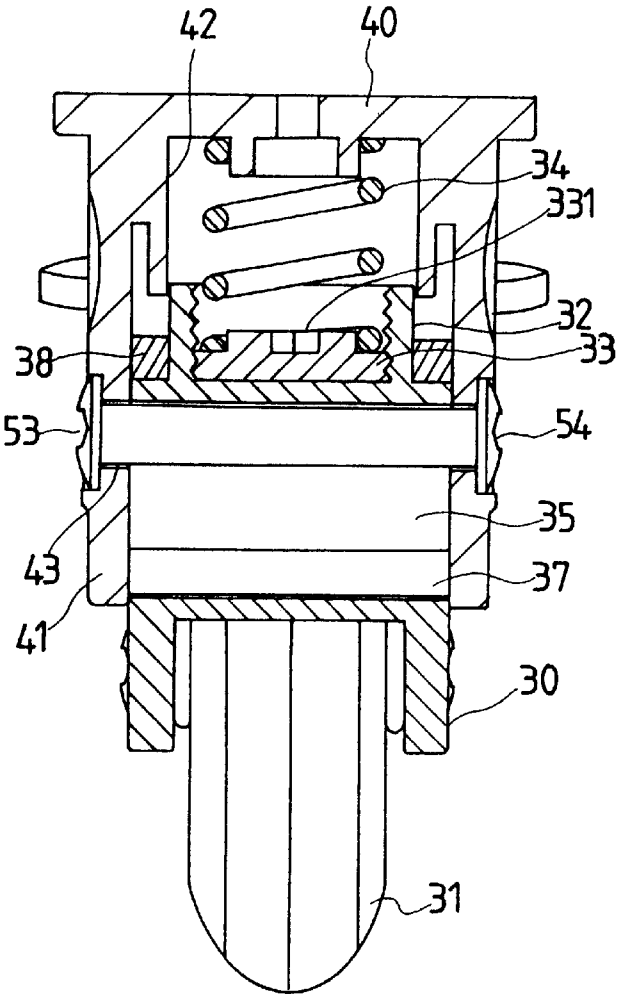
FIG. 3 is a cross sectional view taken along lines 3—3 of FIG. 1.

Referring to the drawings, and initially to FIGS. 1–3, a in-line roller skate in accordance with the present invention comprises a base 30 and a support 40 having one end, preferably the front end, pivotally coupled together by a pivot pin 51 which is engaged through the holes 36, 44 of the base 30 and the support 40 and is engaged with a locking fastener 52. The support 40 is provided for supporting a boot as that of the typical roller skates. A number of wheels 31 are rotatably attached to the base 30. The base 30 includes a pair of slots 35, preferably each being a vertical slot, laterally formed in the middle portion for receiving a resilient member 37 and includes a hub 32 formed in the middle portion and having an inner thread.

The support 40 includes a pair of extensions 41 extended downward for engaging with the side portions of the base 30 and for guiding the support 40 to move upward and downward relative to the base 30 and for preventing the support 40 from moving laterally relative to the base 30. The extensions 41 each includes an aperture 43 for engaging with a shaft 53 which is secured to the support 40 by a fastener 54. The shaft 53 is slidably engaged in the pair of slots 35 and is limited to move up and down relative to the base 30 by the size of the pair of slots 35. The support 40 includes a guide wall 42 slidably engaged on the hub 32 and having a cylindrical or planer shape, for further limiting the support 40 to move upward and downward relative to the base 30 only. The resilient member 37 may be retained in place by the extensions 41 (FIGS. 3, 4).

Figure 4:
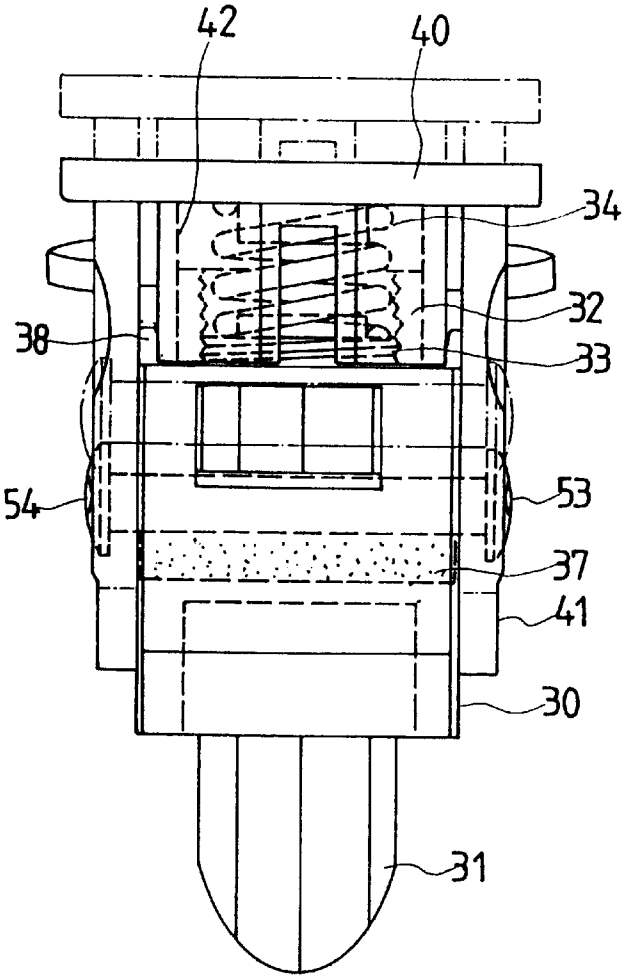
FIG. 4 is a schematic view similar to FIG. 3, illustrating the operation of the roller skate.
Figure 5:
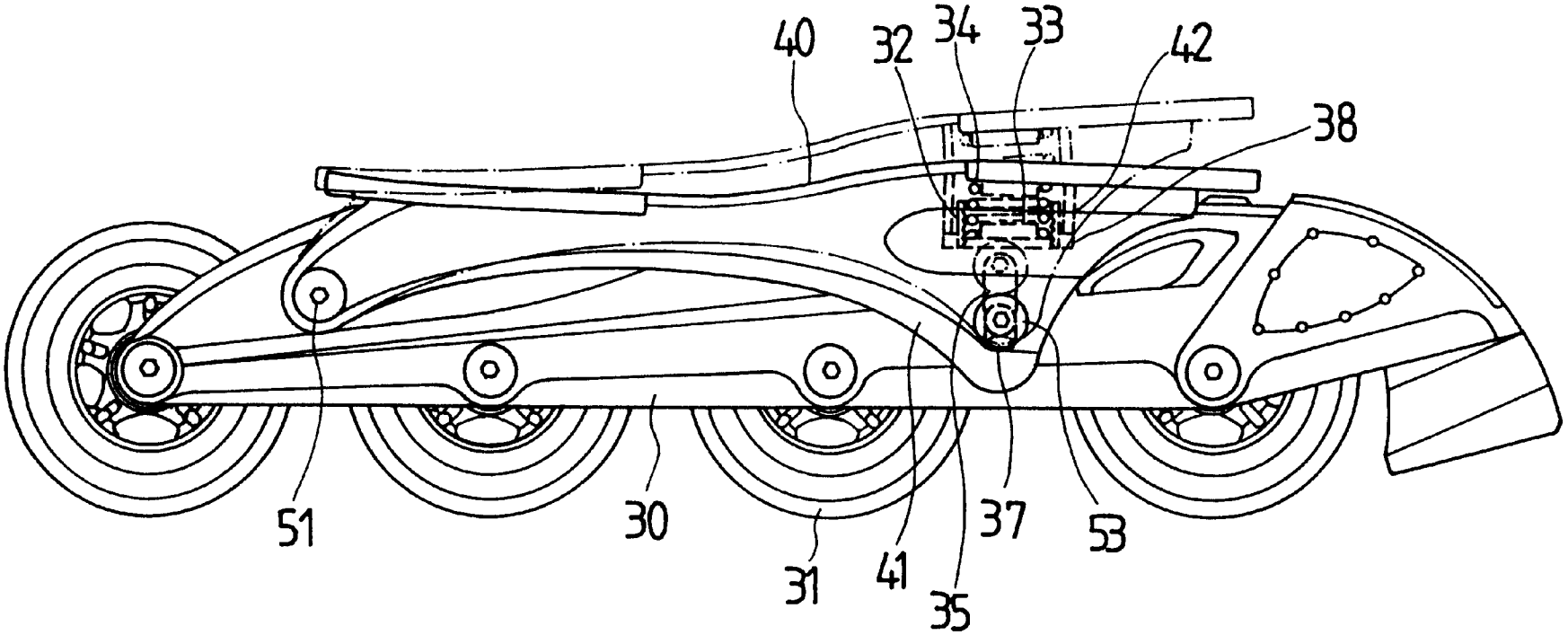
FIG. 5 is a plan view illustrating the operation of the roller skate.

A resilient ring 38 is disposed around the hub 32 for engaging with and for cushioning the guiding wall 42 (FIGS. 3–5). A bolt 33 is threadedly engaged with the inner thread of the hub 32 and has an engaging hole 331 for engaging with a wrench or screw driver and for allowing the bolt 33 to be adjusted up and down relative to the hub 32. A spring 34 is engaged between the support 40 and the bolt 33 for cushioning the support 40. The adjustment of the bolt 33 relative to the hub 32 may be used for adjusting the spring force of the spring 34. The shaft 53 may engage with the resilient member 37 which forms as a further cushioning mechanism (FIGS. 4, 5).

Figure 6:
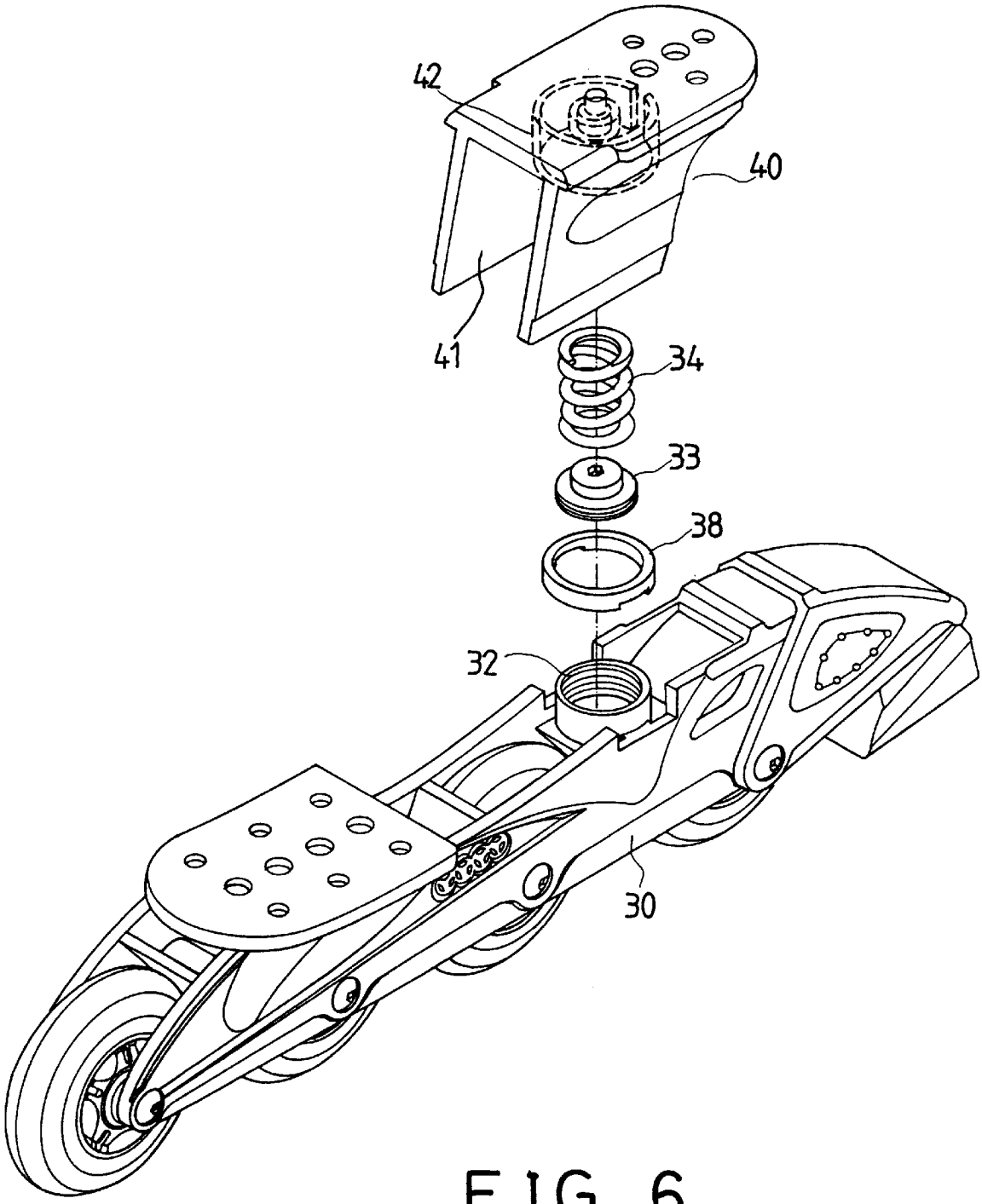
FIG. 6 is an exploded view illustrating another application of the roller skate.

Referring next to FIG. 6, the support 40 may includes a rear segment of that shown in FIGS. 1 and 2 only and is secured to the heel portion of the boot and may also be guided and limited to stably move relative to the base 30 also. The resilient ring 38 and the resilient member 37 and the bolt 33 may optionally be provided. Without the adjustment of the bolt 33, the spring 34 may be selected for applying a suitable spring force between the support 40 and the base 30.

Accordingly, the roller skate includes a stable suspension system for stably guiding the boot to move upward and downward relative to the base and for preventing the roller skate from being easily damaged.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A roller skate comprising:

a base for supporting wheels, said base including two side portions and a middle portion having a hub, said two side portions having a pair of slots formed therein, a support for attachment to a boot, said support including a pair of extensions extending downwardly for slidably engaging with said two side portions of said base and for guiding and limiting said support to move up and down relative to said base, a shaft extending through said extensions of said support and slidably engaged in said pair of slots of the two side portions of said base with said hub positioned between said support and said shaft for limiting an up and down movement of said support relative to said hub, a spring member engaged between said hub and said support for biasing said support away from said base, and a resilient member extending between said pair of slots and engaged between the middle portion of said base and said shaft for cushioning said shaft.

2. The roller skate according to claim 1, wherein said support includes a guide wall extended downward and slidably engaged on said hub for further guiding said support to move upward and downward relative to said base.

3. The roller skate according to claim 2 further comprising a resilient ring engaged around said hub for engaging with said guide wall of said support and for cushioning said support.

4. The roller skate according to claim 1 further comprising a bolt slidably engaged in said hub of said base and adapted to be adjusted up and down relative to said hub, said spring member being engaged with said bolt for allowing said bolt to adjust said spring member.

5. The roller skate according to claim 4, wherein said bolt includes an engaging hole for allowing said bolt to be rotated relative to said hub.

6. The roller skate according to claim 1, wherein said support includes a front portion pivotally coupled to said base at a pivot pin.

* * * * *